US009205448B2

(12) United States Patent
Karunakaran

(10) Patent No.: US 9,205,448 B2
(45) Date of Patent: Dec. 8, 2015

(54) ROLLER CLEANING ASSEMBLY

(75) Inventor: Palanisami Karunakaran, New South Wales (AU)

(73) Assignee: MAK ENGINEERING PROJECTS PTY LIMITED (AU)

( * ) Notice: Subject to any disclaimer, the term of this patent is extended or adjusted under 35 U.S.C. 154(b) by 89 days.

(21) Appl. No.: 14/007,143

(22) PCT Filed: Mar. 25, 2011

(86) PCT No.: PCT/AU2011/000343
§ 371 (c)(1),
(2), (4) Date: Nov. 27, 2013

(87) PCT Pub. No.: WO2012/129590
PCT Pub. Date: Oct. 4, 2012

(65) Prior Publication Data

US 2014/0123431 A1 May 8, 2014

(51) Int. Cl.

| | |
|---|---|
| ***B08B 1/00*** | (2006.01) |
| ***D21G 3/00*** | (2006.01) |
| ***B41F 35/00*** | (2006.01) |
| ***B05C 1/08*** | (2006.01) |
| ***B05C 9/04*** | (2006.01) |
| *B05C 11/04* | (2006.01) |

(52) U.S. Cl.
CPC ..... *B05C 1/0817* (2013.01); *B05C 1/0813* (2013.01); *B05C 9/04* (2013.01); *B08B 1/00* (2013.01); *D21G 3/00* (2013.01); *B05C 11/041* (2013.01); *B41P 2235/21* (2013.01)

(58) Field of Classification Search
CPC ..... B08B 1/00; B05C 1/00; B05C 11/00; B41L 41/00; B41F 35/00; G03G 21/00; G03G 2215/00; G03G 2221/00; D21G 3/00
USPC ..... 15/256.51, 256.53; 118/104, 203, 261; 101/423, 425; 162/272; 399/327, 343, 399/345, 351, 353
See application file for complete search history.

(56) References Cited

U.S. PATENT DOCUMENTS

| | | | | |
|---|---|---|---|---|
| 2,728,103 | A * | 12/1955 | Benedict et al. | 425/230 |
| 3,327,341 | A * | 6/1967 | Kuehn | 15/256.51 |
| 3,399,420 | A * | 9/1968 | Crist | 15/256.51 |

(Continued)

FOREIGN PATENT DOCUMENTS

| | | | |
|---|---|---|---|
| DE | 19741518 | * | 3/1999 |
| GB | 2459293 | | 10/2009 |
| JP | 5-345409 | * | 12/1993 |

OTHER PUBLICATIONS

International Search Report corresponding to International Application No. PCT/AU2011/000343.

(Continued)

*Primary Examiner* — Mark Spisich
(74) *Attorney, Agent, or Firm* — Niels Haun; Dann Dorfmann Herrell & Skillman, PC

(57) ABSTRACT

A roller cleaning assembly including: a main body support; and, a contact portion including an elongate cleaning surface for contacting an outside cylindrical surface of a roller, the contact portion being coupled to the main body support and moveable therefrom between a retracted position where the cleaning surface is remote from the roller and an engaged position where the cleaning surface is in contact with an outside cylindrical surface of the roller.

18 Claims, 8 Drawing Sheets

(56) References Cited

U.S. PATENT DOCUMENTS

| | | | | |
|---|---|---|---|---|
| 3,722,465 | A * | 3/1973 | Krautzberger | 118/123 |
| 3,750,228 | A * | 8/1973 | Wake | 15/256.53 |
| 4,165,965 | A * | 8/1979 | Bernardelli et al. | 432/75 |
| 5,768,993 | A | 6/1998 | Stuart | |
| 2010/0236009 | A1 | 9/2010 | Porco | |

OTHER PUBLICATIONS

Written Opinion of the International Preliminary Examining Authority corresponding to International Application No. PCT/AU2011/000343.

International Preliminary Report on Patentability corresponding to International Application No. PCT/AU2011/000343.

* cited by examiner

ROLLER CLEANING ASSEMBLY

The present invention relates to a roller cleaning assembly and a method of cleaning a roller assembly.

BACKGROUND

Roller assemblies are used in many industrial environments and are commonly associated with moving sheet type materials around through various processes. In addition, they are often used as applicators to coat sheet material, such as metal sheeting with various coatings including resin or paint.

Such roller assemblies typically use a roller coating to apply resin or paint. However, particles often accumulate and the roller also builds up a thin layer of the material being applied and this affects the uniformity and thickness of the coating onto the metallic sheet. To date, there has not been an automated method for cleaning such roller assemblies that provides uniform cleaning whilst maintaining safety for the workers involved.

Accordingly, the present invention seeks to provide a roller cleaning assembly that provides a uniform pressure and consistently clean result for a roller on a regular basis.

SUMMARY

According to one aspect the present invention provides a roller cleaning assembly including:

a main body support; and, a contact portion including an elongate cleaning surface for contacting an outside cylindrical surface of a roller, the contact portion being coupled to the main body support and moveable therefrom between a retracted position where the cleaning surface is remote from the roller and an engaged position where the cleaning surface is in contact with an outside cylindrical surface of the roller.

In one form the main body support includes a bladder positioned between the main body support and the contact portion, wherein the bladder is able to change between a deflated state and an expanded state by changing the pressure of a fluid contained within the bladder, wherein when the bladder changes from the deflated state to the expanded state the bladder pushes the contact portion into the engaged position and away from the main body support.

In one form the roller cleaning assembly further includes a bias coupled between the main body support and the contact portion wherein the bias acts to bias the contact portion towards the main body support into the retracted position. In one form the bias acts to move the contact portion back to the retracted position when the bladder changes from an expanded state to a deflated state.

In one form the main body support and the contact portion are elongate and substantially the same length as the length of the outside cylindrical surface of the roller, wherein the contact portion is positioned between the roller and the main body support. In one form the resilient bladder is the form of an elongate tube which is housed in an elongate conduit located between the main body support and the contact portion.

In one form the main body support and the contact portion are coupled together by two supporting arms which are located on either side of the elongate conduit wherein the supporting arms are able to extend when the contact portion is in the engaged position and then retract when the contact portion is in the retracted position. In one form the two supporting arms are in the form of elongate rails which extend along the length of the main body support and the contact portion. In one form the two supporting arms are elongate extensions from the contact portion which extend into and are retained by corresponding receiving cavities within the main body support.

In one form the bias is in the form of an elongate resilient sheet which is located along at least one of the sides of the roller cleaning assembly, wherein the elongate resilient sheet is attached to the main body support and the contact portion. In one form the bias includes a second elongate resilient sheet which is located along the other side of the roller cleaning assembly wherein the second elongate resilient sheet is attached to the main body support and the contact portion. In one form the bias is composed of a resilient or elastic material such as for example silicon or polyurethane.

In one form the cross section of the contact portion is substantially, 'U' shaped and the contact portion includes two elongate cleaning surfaces which are located at the top of the U shape with a collecting cavity located between the two elongate cleaning surfaces.

In one form the two elongate cleaning surfaces include a passive elongate cleaning surface and an active elongate cleaning surface wherein the active elongate cleaning surface contacts the outside cylindrical surface of the roller when the roller is rotating in the direction towards the active elongate cleaning surface when the contact portion is in the engaged position.

In one form the collecting cavity runs the length of the roller cleaning assembly and collects particles removed from the roller during cleaning. In one form the collecting cavity includes a plurality of apertures for dispensing a fluid into the collecting cavity wherein the fluid assists in the cleaning of the roller and/or the fluid assists in dispersing particles collected in the collecting cavity. In one form the plurality of apertures are in fluid communication with a central conduit for delivering fluid to the plurality of apertures.

In one form the elongate cleaning surfaces are located on respective rail supports wherein the rail supports are able to be engaged and retained on the contact portion in a slidable arrangement. In this form the cross sectional profile of the rail supports correspond with the cross sectional profile of the contact portion. In one form the two rail supports are connected via a connecting region forming an integral 'U' shaped structure.

In one form an oscillator is coupled to the roller cleaning assembly which moves the contact portion and the cleaning surface in a longitudinal oscillating manner against the outside cylindrical surface of the roller.

In one form the cleaning surface includes a toothed arrangement for contacting the outside cylindrical surface of the roller.

BRIEF DESCRIPTION OF THE ACCOMPANYING FIGURES

The present invention will become better understood from the following detailed description of various non-limiting embodiments thereof, described in connection with the accompanying figures, wherein.

DESCRIPTION OF EMBODIMENTS AND THE ACCOMPANYING FIGURES

The foregoing describes only some embodiments of the present invention, and modifications and/or changes can be made thereto without departing from the scope and spirit of the invention, the embodiments being illustrative and not restrictive.

In the context of this specification, the word "comprising" means "including principally but not necessarily solely" or "having" or "including", and not "consisting only of". Variations of the word "comprising", such as "comprise" and "comprises" have correspondingly varied meanings.

Figure 1:
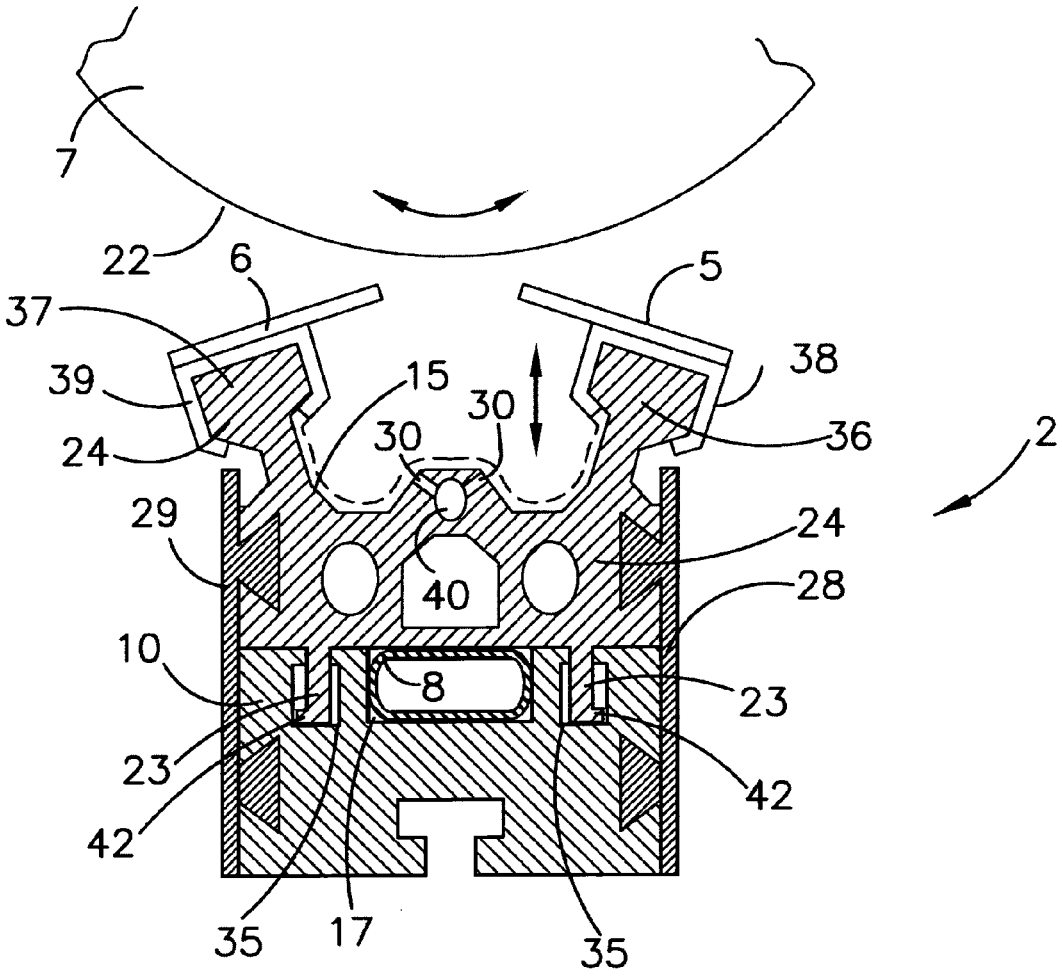
FIG. 1 is a cross-sectional view of a roller cleaning assembly with the contact portion in the retracted position in accordance with one embodiment of the present invention.
Figure 2:
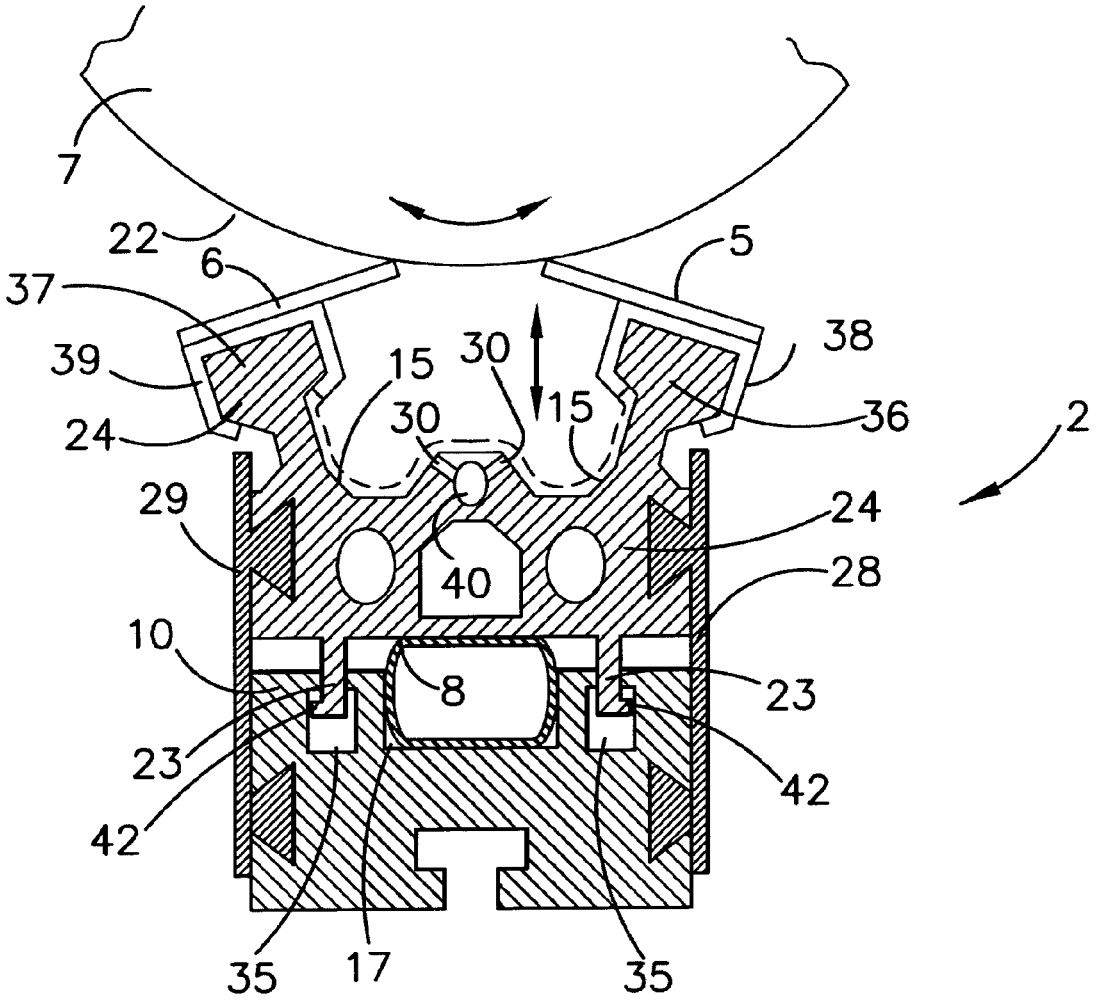
FIG. 2 is a cross-sectional view of the roller cleaning assembly with the contact portion in the engaged position in accordance with one embodiment of the present invention.

FIGS. 1 to 7 show various embodiments of a roller cleaning assembly 2. Referring specifically to FIGS. 1 and 2 there is shown a cross-sectional profile of a roller cleaning assembly 2 in connection with a roller 7 to be cleaned by the roller cleaning assembly 2.

The roller cleaning assembly 2 includes an elongate main body support 10 that is coupled to an elongate contact portion 24 by means of two arms 23 in the form of elongate rails extending from the contact portion 24 into corresponding receiving cavities 35. The two arms 23 are retained within the receiving cavities 35 whilst still allowing the contact portion 24 to move away from the main body support 10 until a flange 42 on the end of the support arms is in contact with a corresponding flange located in the receiving cavities 35, or the elongate contact portion 24 comes into contact with the surface of the roller 7.

The contact portion 24 is substantially U-shaped in cross-section and includes an elongate cleaning surface 5, 6 at either end of the U-shape for contacting the entire length of the outer cylindrical surface 22 of the roller 7 to be cleaned. The elongate cleaning surface 5, 6 is made up of a passive cleaning surface 6 and an active cleaning surface 5 (when the rotation of the roller is anti-clockwise). Between the two cleaning surfaces 5, 6 there is located a collecting cavity 15. Within the collecting cavity apertures 30 are located which are able to deliver a fluid which is delivered to the apertures 30 via a central conduit 40 which runs along the length of the elongate contact portion 24.

The elongate cleaning surfaces 5, 6 are attached to the ends 36, 37 of the U-shape of the contact portion 24 by means of corresponding rails 38, 39 which slide along the length of the ends 36, 37 of the contact portion 24. Such an arrangement provides that the cleaning surfaces 5, 6 may be removed from the contact portion 24 and cleaned and/or replaced with alternative cleaning surfaces quickly and easily.

An alternative assembly in accordance with a further embodiment is also shown in FIG. 1 where the rails 38, 39 are joined via a connecting region shown in phantom lines. The connecting region together with rails 38, 39 form an integral u shaped structure that includes cleaning surfaces 5, 6 that is able to be coupled to the elongate contact portion 24 in a slidable engagement due to the corresponding cross-sectional shape configuration of the integral u-shaped structure and the contact portion 24. Such an embodiment provides that the cleaning surfaces 5, 6 as well as the collecting cavity 15 may be removed from the contact portion 24 for a quick change during operation. In addition, the connecting region may also include corresponding apertures which allow fluid communication with openings 30 providing that cleaning fluid may also be dispensed into the connecting region to provide a cleaning effect. Alternatively, the connecting region may also include the conduit for delivering the cleaning fluid to the apertures located in the connecting region rather than from conduit 40 as depicted in FIG. 1 and as described above.

Located between the contact portion 24 and the main body support 10 there is an elongate conduit 17 which includes a bladder 8 in the form of an elongate bladder made of resilient material which runs along the length of the roller cleaning assembly 2 between the elongate contact portion 24 and the elongate main body support 10. Whilst not specifically detailed in the figures, the bladder is fed by a supply of fluid, typically air, which allows the bladder to move between an expanded state, as shown in FIG. 2 and a deflated state as shown in FIG. 1. When moving from the deflated state shown in FIG. 1 to the inflated state shown in FIG. 2, the surfaces of the bladder 8 force the contact portion 24 away from the main body support 10 toward the roller 7 until the elongate cleaning surfaces 5, 6 come into contact with the outside cylindrical surface 22 of the roller 7.

The uniform application of the force of the bladder 8 as it expands onto the underside of the elongate contact portion 24 provides that the movement of the contact portion 24 towards the outside cylindrical surface 22 of the roller 7 is at a uniform distance all along the way along the length of the roller 7 providing a uniform application of the cleaning surfaces of the roller. Furthermore, the support arms 23 located either side of the elongate conduit 17 housing the bladder 8 provide that the contact portion moves in a directly vertical alignment towards the roller 7 when moving the contact portion 24 into an engaged position.

Once the fluid within the bladder 8 is reduced in pressure and the bladder 8 moves from an inflated state shown in FIG. 2 to a deflated state shown in FIG. 1, a bias in the form of a resilient elongate sheet 29, 28 located on the sides of the roller assembly 2 and attached to both the contact portion 24 and the main body support 10 pulls the contact portion 24 back towards the main body support 10 such that the elongate cleaning surface is moved from contacting the outside cylindrical surface 22 of the roller 7. As such, the contact portion 24 is able to move between a retracted position where the bias 29, 28 holds the contact portion 24 against the main body support 10 and an engaged position where the bladder by virtue of an increased fluid pressure overcomes the biasing force of the bias 29, 28 and pushes the contact portion 24 away from the main body support 10 until the elongate cleaning surface 5, 6 is in contact with the outside cylindrical surface 22 of the roller 7.

The bias in the form of a resilient elongate sheet 29, 28 located on either side of the roller assembly further ensures that the movement of the contact portion 24 is in a uniform manner displaced away from the main body support 10 which provides that the elongate cleaning surface 5, 6 contacts in a substantially flush fashion with the entire length of the outside cylindrical surface 22 of the roller 7. The resilient elongate sheet 29, 28 may be composed of a suitably resilient or elastic material such as for example silicon or polyurethane.

During operation, the roller cleaning assembly is generally in the retracted arrangement where the bias 29, 28 retains the contact portion against the main body support 10 in a retracted position. Once it is desired that the roller 7 be cleaned, an increase in fluid pressure is applied to the bladder 8 which expands the bladder 8 to a point where the force provided by the bladder 8 on the contact portion 24 overcomes the biasing force of the bias 28, 29. The contact portion 24 then proceeds to move away from the main body support 10 towards the roller 7 until the elongate cleaning surface 5, 6 comes into contact with the outside cylindrical surface 22 of the roller 7. Depending upon the rotation of the roller 7, the elongate cleaning surface 5, 6 includes passive or active cleaning surfaces. An active cleaning surface has the roller moving towards the main cleaning surface such that the roller surface is meeting the elongate cleaning surface at an obtuse angle. For example in the present embodiments shown in FIGS. 1 and 2, the elongate cleaning surface 5 is the active cleaning surface when the roller 7 is rotating in an anti-clockwise direction.

The active cleaning surface therefore removes the majority of the particulate matter that may be present on the outside cylindrical surface of the roller 7. This particulate matter falls into the collecting cavity 15 once removed from the roller surface by the elongate cleaning surface 5 which is then moved towards an end of the roller cleaning assembly for collection. Apertures 30 dispensing a fluid such as water also assist in dispersing any particular matter that may be collected in the collecting cavity 15 towards an end for collection.

Figure 3:
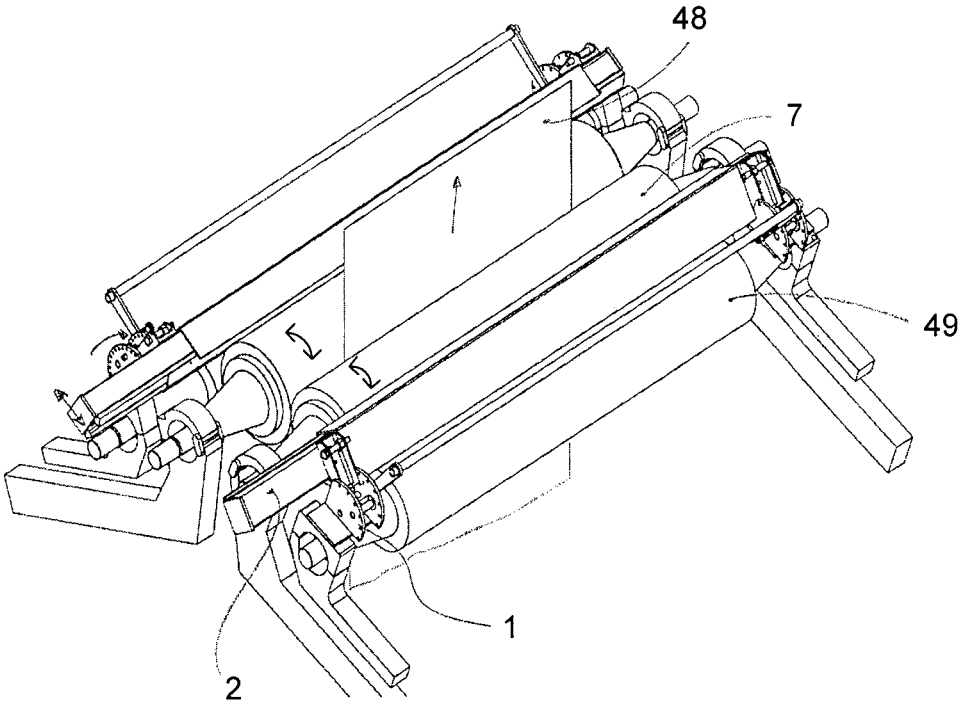
FIG. 3 is a perspective view of the roller cleaning assembly in conjunction with a roller assembly for coating a sheet material.
Figure 4:
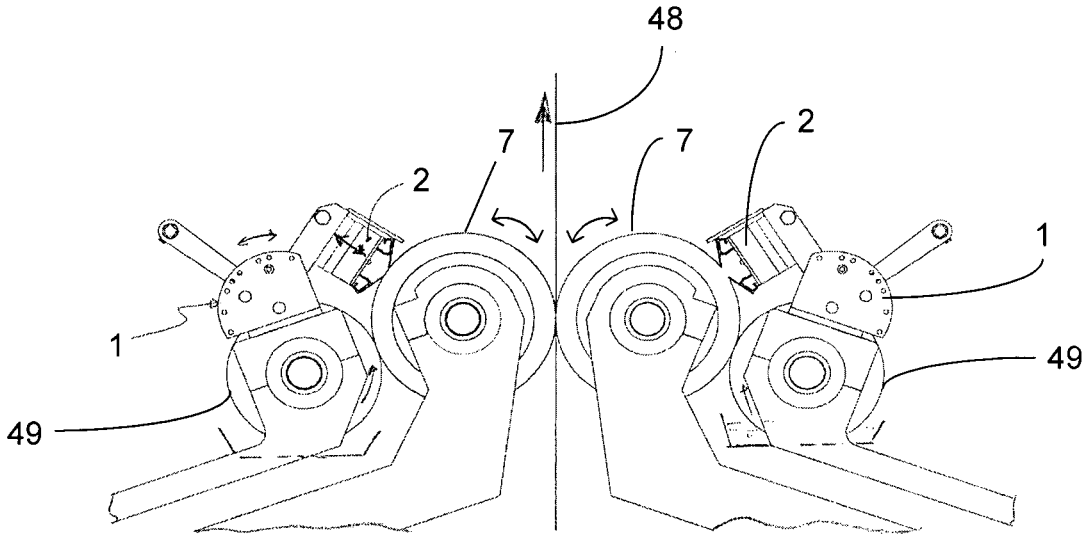
FIG. 4 is a cross-sectional view of the roller assembly of FIG. 3.

Referring now to FIGS. 3 and 4, there is shown a roller cleaning assembly 2 in position with a typical roller assembly for coating a strip of metal 48 with resin or paint. An applicator roll 7 is fed the resin or paint to be applied by a pick up roller which is typically positioned to pick up the paint or resin held in a trough shown in FIG. 4. The roller cleaning assembly may be further moved between an on-line position as shown in FIGS. 3 and 4 and an off-line position (not shown) by means of a pivoting mechanism which displaces the roller cleaning assembly 2 away from the location of the rollers 7.

Figure 5:
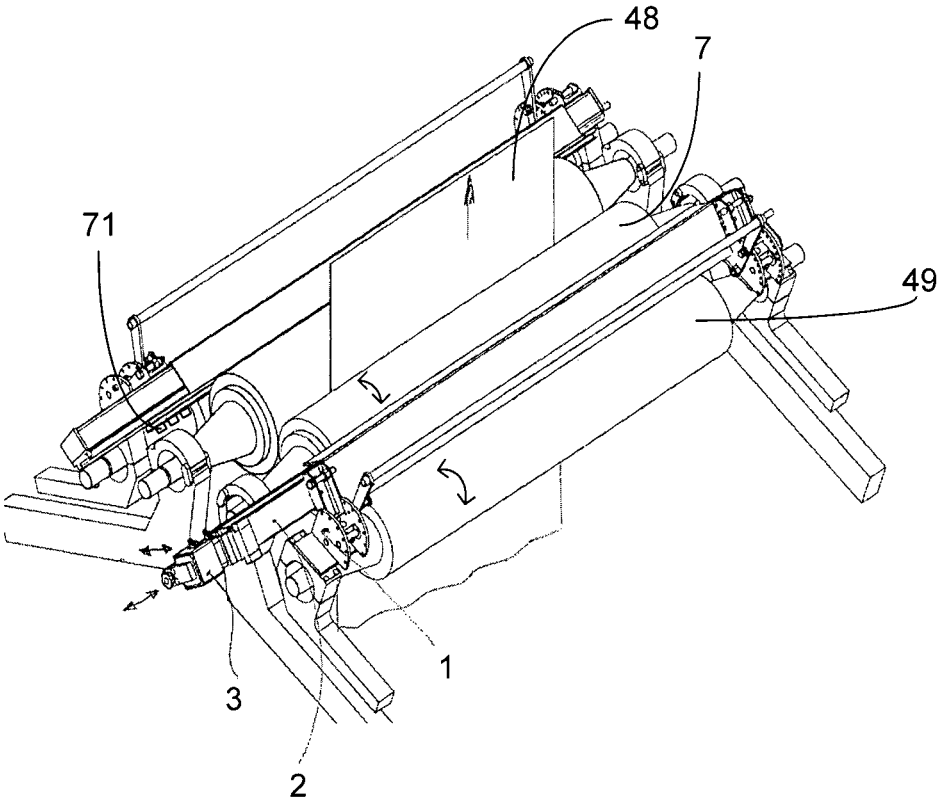
FIG. 5 is a perspective view of a roller cleaning assembly in conjunction with a roller assembly for coating a sheet material.
Figure 6:
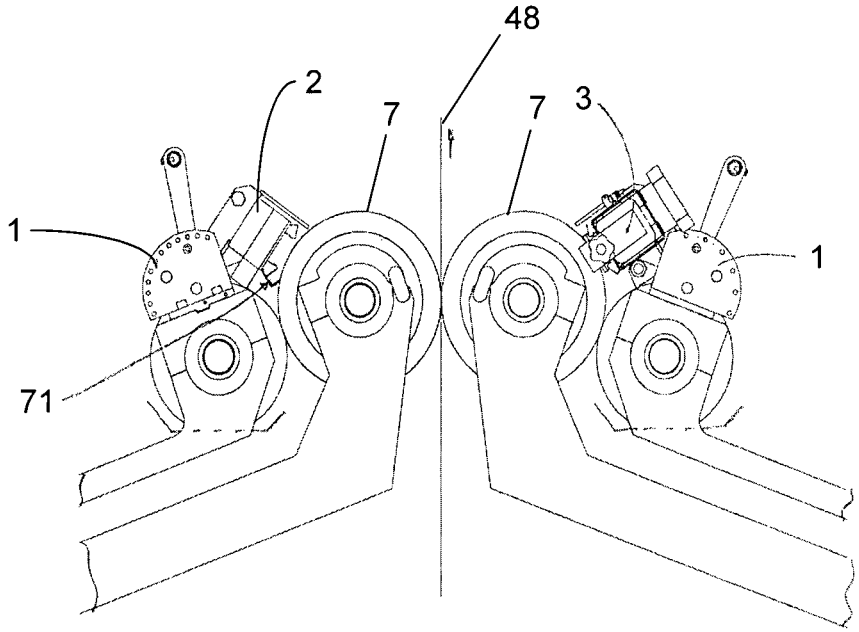
FIG. 6 is a cross-sectional view of the roller assembly of FIG. 5.

Referring now to FIGS. 5 and 6 there is shown a further embodiment shown including an oscillating module 3 which is connected to the roller cleaning assembly 2 and provides that the roller cleaning assembly oscillates whereby the cleaning surface contacting the outside cylindrical surface of the roller 7 oscillates to assist in removing any particles which are located on the roller 7 to be cleaned. In such an arrangement, it is often useful to use a fine toothed oscillating blade 71 as the active cleaning surface.

Figure 7:
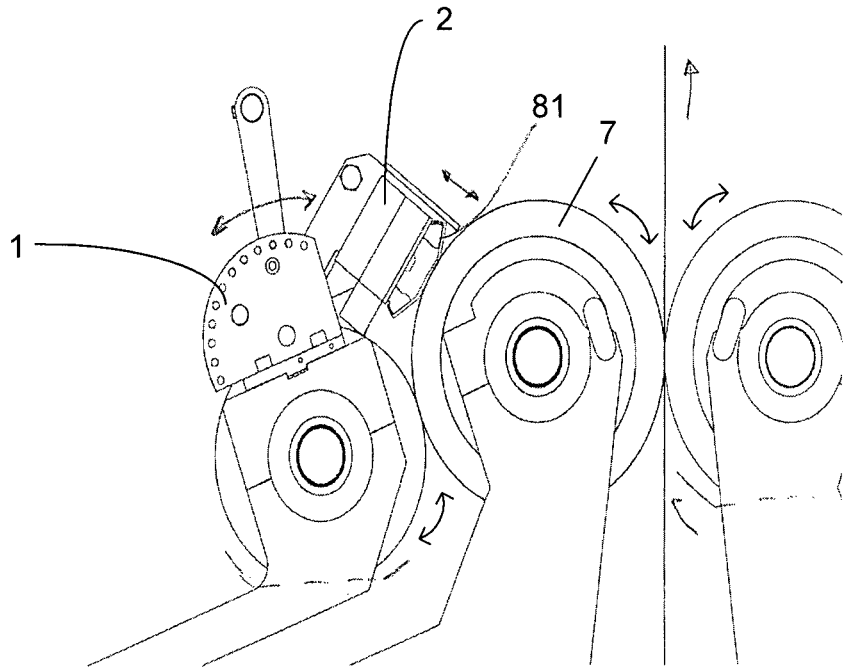
FIG. 7 is a cross-sectional view of a further embodiment of a roller cleaning assembly together with a roller assembly for coating a sheet material; and, FIG. 8 is a cross-sectional view of a further embodiment of a roller cleaning assembly together with a roller assembly for coating a sheet material.

Referring now to FIG. 7 there is shown an alternative embodiment whereby the cleaning surface is in the form of an abrasive pad 81 which may be fitted to the contact portion 24 of the roller cleaning assembly 2 to provide an alternative means of contacting the outside cylindrical surface 22 of the roller 7.

Figure 8:
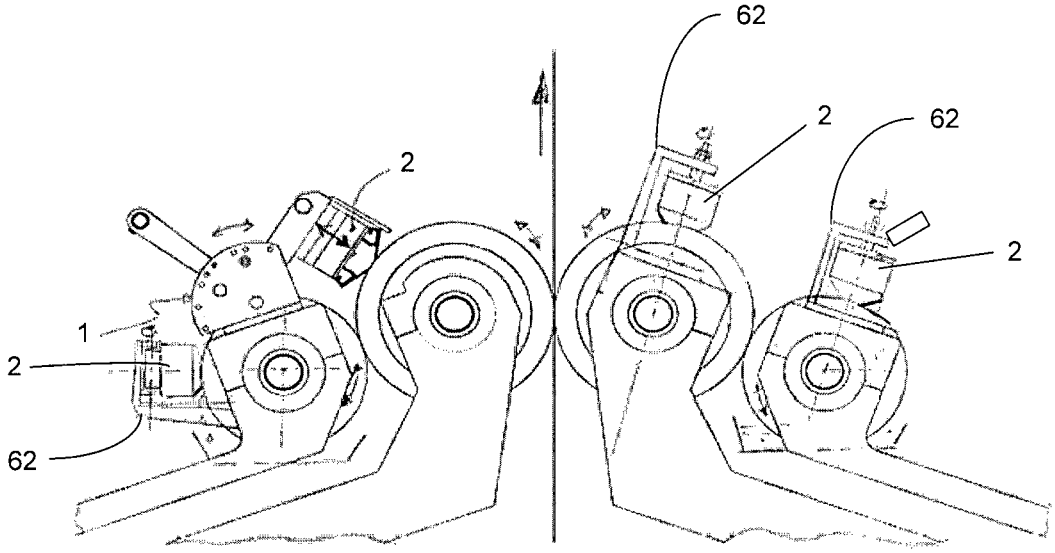

Referring to FIG. 8 there is shown a further embodiment when roller cleaning assemblies according to an embodiment of the invention are shown in position on each of the four rollers. Three of the roller cleaning assemblies 2 are shown in position by means of a arm support 62. The arm support 62 are mounted to the bearing assembly of each roller and are thereby able to provide a support to the roller cleaning assembly 2 that allows uniform cleaning force be provided along the outer circumferential surface of the rollers that is independent of differential pressures that may be between the rollers themselves.

Often during the lifetime of a roller located on a production line, variables such as roll alignment, strip shape will require differential pressure along the outside cylindrical surface of the roller. If this occurs, the orientation of the roller is often moved about its bearing axis to ensure an even coating application. By mounting the arm support 62 on the bearing assembly of the roller, the cleaning assembly is automatically aligned with the orientation of the roller in the event of adjustment.

Many modifications will be apparent to those skilled in the art without departing from the scope of the present invention.

The invention claimed is:

1. A roller cleaning assembly including:

a main body support;

a contact portion including an elongate cleaning surface for contacting an outside cylindrical surface of a roller, the contact portion being coupled to the main body support and moveable therefrom between a retracted position where the cleaning surface is remote from the roller and an engaged position where the cleaning surface is in contact with an outside cylindrical surface of the roller;

a bladder positioned between the main body support and the contact portion, wherein the bladder is able to change between a deflated state and an expanded state by changing the pressure of a fluid contained within the bladder, wherein when the bladder changes from the deflated state to the expanded state the bladder pushes the contact portion into the engaged position and away from the main body support; and a bias coupled between the main body support and the contact portion wherein the bias acts to move the contact portion back to the retracted position when the bladder changes from an expanded state to a deflated state;

wherein the main body support, the contact portion, and the bladder are elongate and substantially the same length as the length of the outside cylindrical surface of the roller, wherein the contact portion is positioned between the roller and the main body support, and wherein the bias is in the form of two elongate resilient sheets wherein a first elongate resilient sheet is located along one of the sides of the roller cleaning assembly and is attached between the main body support and the contact portion and wherein the second elongate resilient sheet is located along the other side of the roller cleaning assembly and is attached between the main body support and the contact portion.

2. A roller cleaning assembly according to claim 1 wherein the bladder is in the form of an elongate tube which is housed in an elongate conduit located between the main body support and the contact portion.

3. A roller cleaning assembly according to claim 2 wherein the main body support and the contact portion are coupled together by two supporting arms which are located on either side of the elongate conduit wherein the supporting arms are able to extend when the contact portion is in the engaged position and then retract when the contact portion is in the retracted position, wherein the two supporting arms are in the form of elongate rails which extend along the length of the main body support and the contact portion.

4. A roller cleaning assembly according to claim 3 wherein the two supporting arms are elongate extensions from the contact portion which extend into and are retained by corresponding receiving cavities within the main body support.

5. A roller cleaning assembly according to claim 1 wherein the cross section of the contact portion is substantially U shaped and the contact portion includes two elongate cleaning surfaces which are located at the top of the U shape with a collecting cavity located between the two elongate cleaning surfaces.

6. A roller cleaning assembly according to claim 5 wherein the two elongate cleaning surfaces include a passive elongate cleaning surface and an active elongate cleaning surface wherein the active elongate cleaning surface contacts the outside cylindrical surface of the roller when the roller is rotating in the direction towards the active elongate cleaning surface when the contact portion is in the engaged position.

7. A roller cleaning assembly according to claim 5 wherein the collecting cavity runs the length of the roller cleaning assembly and collects particles removed from the roller during cleaning.

8. A roller cleaning assembly according to claim 5 wherein the collecting cavity includes a plurality of apertures for dispensing a fluid into the collecting cavity wherein the fluid assists in the cleaning of the roller and/or the fluid assists in dispersing particles collected in the collecting cavity.

9. A roller cleaning assembly according to claim 8 wherein the plurality of apertures are in fluid communication with a central conduit for delivering fluid to the plurality of apertures.

10. A roller cleaning assembly according to claim 5 wherein the two elongate cleaning surfaces are located on respective rail supports wherein the rail supports are able to be engaged and retained on the contact portion in a slidable arrangement.

11. A roller cleaning assembly according to claim 10 wherein the cross sectional profile of the rail supports correspond with the cross sectional profile of the contact portion.

12. A roller cleaning assembly according to claim 11 wherein the two rails supports are connected via a connecting region forming an integral 'U' shaped structure.

13. A roller cleaning assembly according to claim 1 wherein an oscillator is coupled to the roller cleaning assembly which moves the contact portion and the cleaning surface in a longitudinal oscillating manner against the outside cylindrical surface of the roller.

14. A roller cleaning assembly according to claim 1 wherein the cleaning surface includes a toothed arrangement for contacting the outside cylindrical surface of the roller.

15. A roller cleaning assembly according to claim 1 wherein the roller cleaning assembly is mounted such that the contact portion is applied with uniform pressure to the outer circumferential surface of the roller.

16. A roller cleaning assembly according to claim 15 wherein the roller cleaning assembly is mounted in a fixed relationship relative to the axis of rotation of the roller.

17. A roller cleaning assembly including:

a main body support;

a contact portion including elongate cleaning surface for contacting an outside cylindrical surface of a roller, the contact portion being coupled to the main body support and moveable therefrom between a retracted position where the cleaning surface is remote from the roller and an engaged position where the cleaning surface is in contact with an outside cylindrical surface of the roller;

a bladder positioned between the main body support and the contact portion, wherein the bladder is able to change between a deflated state and an expanded state by changing the pressure of a fluid contained within the bladder, wherein when the bladder changes from the deflated state to the expanded state the bladder pushes the contact portion into the engaged position and away from the main body support; and a bias coupled between the main body support and the contact portion wherein the bias acts to move the contact portion back to the retracted position when the bladder changes from an expanded state to a deflated state;

wherein the main body support, the contact portion, and the bladder are elongate and substantially the same length as the length of the outside cylindrical surface of the roller, wherein the contact portion is positioned between the roller and the main body support; and wherein the bladder is the form of an elongate tube which is housed in an elongate conduit located between the main body support and the contact portion, and wherein the main body support and the contact portion are coupled together by two supporting arms which are located on either side of the elongate conduit wherein the supporting arms are able to extend when the contact portion is in the engaged position, wherein the two supporting arms are in the form of elongate rails extending from the contact portion which extend into and are retained by corresponding receiving cavities within the main body support.

18. A roller cleaning assembly including:

a main body support;

a contact portion including a elongate cleaning surface for contacting an outside cylindrical surface of a roller, the contact portion being coupled to the main body support and moveable therefrom between a retracted position where the cleaning surface is remote from the roller and an engaged position where the cleaning surface is in contact with an outside cylindrical surface of the roller;

a bladder positioned between the main body support and the contact portion, wherein the bladder is able to change between a deflated state and an expanded state by changing the pressure of a fluid contained within the bladder, wherein when the bladder changes from the deflated state to the expanded state the bladder pushes the contact portion into the engaged position and away from the main body support; and a bias coupled between the main body support and the contact portion wherein the bias acts to move the contact portion back to the retracted position when the bladder changes from an expanded state to a deflated state;

wherein the main body support, the contact portion, and the bladder are elongate and substantially the same length as the length of the outside cylindrical surface of the roller, wherein the contact portion is positioned between the roller and the main body support; and wherein the cross section of the contact portion is substantially U shaped and the contact portion includes two elongated cleaning surfaces which are located at the top of the U shape.

* * * * *